US008196225B1

(12) United States Patent
Nicks

(10) Patent No.: US 8,196,225 B1
(45) Date of Patent: Jun. 12, 2012

(54) EMBELLISHED JEANS SYSTEM

(76) Inventor: Jessica L. Nicks, Clearwater, FL (US)

( * ) Notice: Subject to any disclaimer, the term of this patent is extended or adjusted under 35 U.S.C. 154(b) by 413 days.

(21) Appl. No.: 12/584,692

(22) Filed: Sep. 10, 2009

(51) Int. Cl.
*A41D 27/08* (2006.01)

(52) U.S. Cl. ..... 2/244

(58) Field of Classification Search ..... 2/244, 245, 2/80, 75, 209.13, 249, 279; 446/26, 28, 27, 446/369, 372
See application file for complete search history.

(56) References Cited

U.S. PATENT DOCUMENTS 1,310,205 A * 7/1919 Morgenstern ..... 446/184
1,552,348 A * 9/1925 Rosenthal ..... 446/99
1,554,136 A * 9/1925 Shafer ..... 446/372
2,593,218 A * 4/1952 Swain ..... 2/48
2,628,452 A * 2/1953 Gladstein ..... 446/28
2,647,222 A * 7/1953 Nieset ..... 315/228
2,705,803 A * 4/1955 Sheldrick et al. ..... 40/586
3,058,262 A * 10/1962 Swedlin ..... 446/346
3,065,568 A * 11/1962 Reiss ..... 446/372
3,226,849 A * 1/1966 Rosen ..... 36/1
3,789,547 A * 2/1974 Chemarin ..... 446/369
4,138,745 A * 2/1979 Greenspan ..... 2/247
4,170,086 A * 10/1979 Hills ..... 446/372
4,268,918 A * 5/1981 Lee ..... 2/172
4,543,669 A * 10/1985 Katz ..... 2/84
4,590,633 A * 5/1986 Pickens ..... 5/482
4,595,618 A * 6/1986 Caringer ..... 428/100
4,681,555 A * 7/1987 Natiw ..... 446/327
4,829,601 A * 5/1989 Spanier ..... 2/49.1
4,860,387 A * 8/1989 Williams ..... 2/244
4,928,321 A * 5/1990 Dobson ..... 2/84
5,007,113 A * 4/1991 Bouadjadja ..... 2/115
D317,798 S * 6/1991 Warcholik ..... D21/596
5,071,385 A * 12/1991 Cox ..... 446/129
5,083,966 A * 1/1992 Blank ..... 446/369
5,084,930 A * 2/1992 Danova ..... 5/502
5,117,507 A * 6/1992 Long ..... 2/158
5,169,701 A * 12/1992 Sander ..... 428/79
5,201,073 A * 4/1993 Spanier ..... 2/49.2
5,398,345 A * 3/1995 Kenneth et al. ..... 2/247
5,542,122 A * 8/1996 Moldovan ..... 2/69
5,561,864 A * 10/1996 DeMars ..... 2/209.13
5,643,037 A * 7/1997 Altschul ..... 446/28
5,781,934 A * 7/1998 Pauley, Jr. ..... 2/209.13
5,933,866 A * 8/1999 Fox ..... 2/115
6,038,698 A * 3/2000 Lawler ..... 2/69
6,153,311 A * 11/2000 Springer et al. ..... 428/542.2
6,233,763 B1 * 5/2001 Spaan ..... 5/485
6,276,074 B1 * 8/2001 Martin ..... 36/100
6,279,167 B1 * 8/2001 Johnson et al. ..... 2/209.13
6,427,267 B1 * 8/2002 Turner ..... 5/482
6,874,166 B2 * 4/2005 Clary ..... 2/171
7,003,810 B2 * 2/2006 Goldkind ..... 2/227
7,237,347 B2 * 7/2007 Tobias ..... 36/112
7,434,271 B2 * 10/2008 Klayman-Grodsky ..... 2/244
2001/0031605 A1 * 10/2001 Kondo et al. ..... 446/484
2004/0068778 A1 * 4/2004 Van Veghel et al. ..... 2/244
2007/0294806 A1 * 12/2007 Harazi ..... 2/244
2008/0096457 A1 * 4/2008 Urias ..... 446/26

(Continued)

*Primary Examiner* — Alissa L Hoey

(57) ABSTRACT

A decorative patch has a base with a head, legs, arms and a torso, all fabricated of a high pile fabric. A plurality of paddings include a tummy, feet, face, eyes and ears, all fabricated of a felted fabric. Stitching couples the paddings to the base. Embroidery through the face padding forms a nose and a mouth. A ribbon in the form of a bow tie is coupled to the base between the tummy and the face.

1 Claim, 2 Drawing Sheets

U.S. PATENT DOCUMENTS

2009/0056727 A1* 3/2009 Hill ..... 128/880
2009/0100571 A1* 4/2009 Soto ..... 2/125
2009/0158502 A1* 6/2009 Medolla et al. ..... 2/227
2010/0058510 A1* 3/2010 Vithlani ..... 2/69
2010/0167619 A1* 7/2010 Adamus ..... 446/74
2010/0319107 A1* 12/2010 Hussein ..... 2/244

* cited by examiner

FIG 1
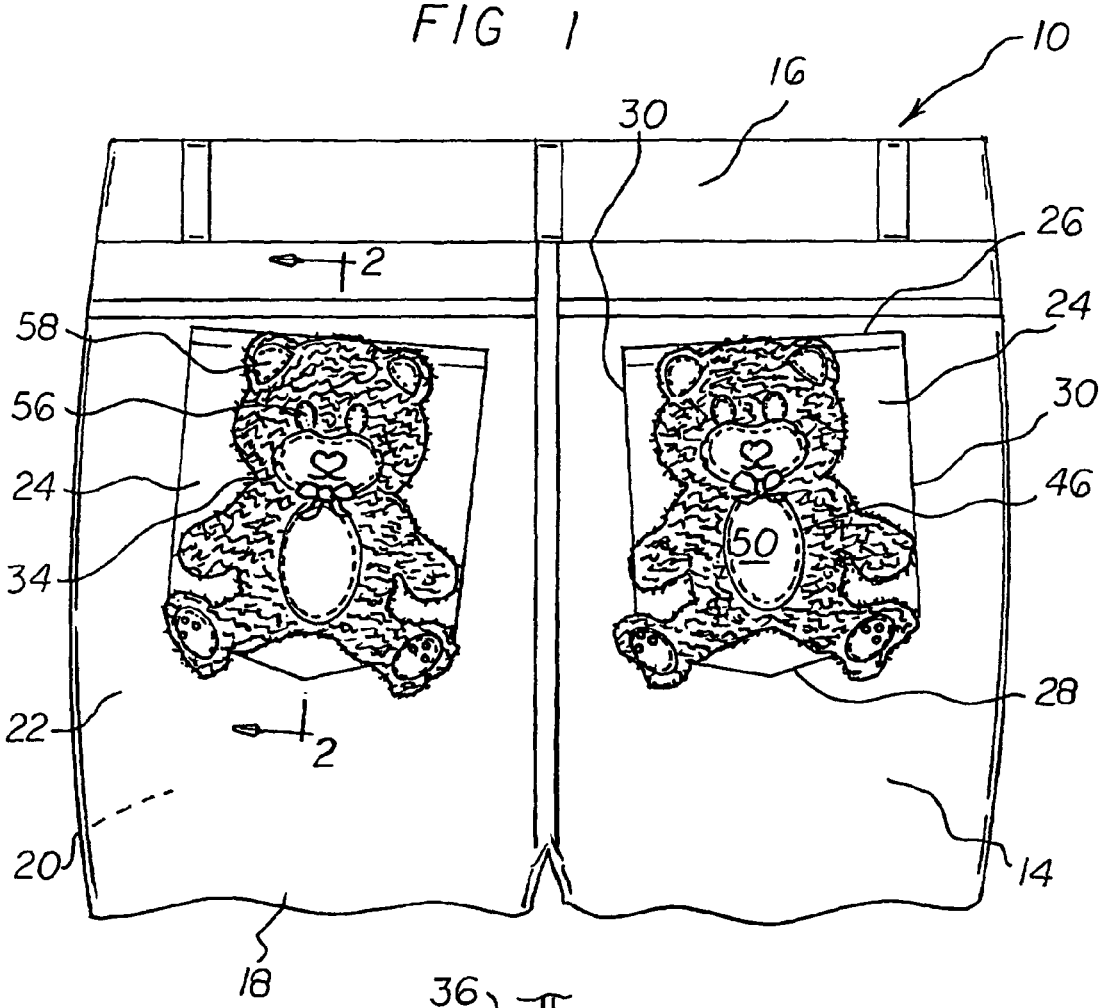
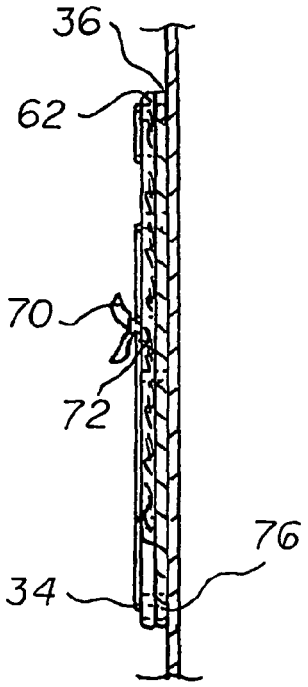
FIG 2

EMBELLISHED JEANS SYSTEM

BACKGROUND OF THE INVENTION

1. Field of the Invention

The present invention relates to an embellished jeans system and more particularly pertains to varying the appearance of garment decorations in response to wearer movement in an entertaining, eye-appealing and economical manner.

2. Description of the Prior Art

The use of embellished clothing of known designs and configurations is known in the prior art. More specifically, embellished clothing of known designs and configurations previously devised and utilized for the purpose of varying the appearance of clothing are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe an embellished jeans system that allows for varying the appearance of garment decorations in response to wearer movement in an entertaining, eye-appealing and economical manner.

In this respect, the embellished jeans system according to the present invention substantially departs from the conventional concepts and designs of the prior art, and in doing so provides an apparatus primarily developed for the purpose of varying the appearance of garment decorations in response to wearer movement in an entertaining, eye-appealing and economical manner.

Therefore, it can be appreciated that there exists a continuing need for a new and improved embellished jeans system which can be used for varying the appearance of garment decorations in response to wearer movement in an entertaining, eye-appealing and economical manner. In this regard, the present invention substantially fulfills this need.

SUMMARY OF THE INVENTION

In view of the foregoing disadvantages inherent in the known types of embellished clothing of known designs and configurations now present in the prior art, the present invention provides an improved embellished jeans system. As such, the general purpose of the present invention, which will be described subsequently in greater detail, is to provide a new and improved embellished jeans system and method which has all the advantages of the prior art and none of the disadvantages.

To attain this, the present invention essentially comprises an embellished jeans system. First provided is a pair of pants. The pants have an upper extent positionable around a waist and hips of a wearer. The pants have a lower extent in the form of two tubular members positionable around the legs of a wearer. The pants have a front and a back. Two similarly configured and laterally spaced pockets are stitched to the back of the pants at the upper extent. Each pocket has a generally rectangular configuration with a top and a bottom and sides. Each pocket has a height of between 5 inches and 7 inches and a width of between 4 inches and 6 inches. The pants are fabricated of a relatively stiff denim fabric.

Next provided are two similarly configured decorative patches. Each patch has a base with a large periphery corresponding to an outline of a bear. Each base has a head above, legs below, arms intermediate and a torso. Each torso is centrally coupled to the head, the legs and the arms. Each base is fabricated of a high pile fabric of false fur. The high pile fabric is formed with strands having a length of between 0.50 inches and 0.75 inches. The high pile fabric is of a first color.

Next, a plurality of paddings is provided for each base. The paddings include a large oval tummy on the torso, two small oval feet on the legs, a shaped face on the head, two small semicircular eyes on the head above the face, and two large semicircular ears on the head above the eyes. All of the paddings are fabricated of a felted fabric with smooth surfaces. Each of the paddings has a small periphery.

Primary stitching couples the small periphery of each padding to the base. The paddings are white and the primary stitching is black for visual contrast. Other visually contrasting color combinations are provided in alternate embodiments of the invention.

Embroidery is provided through each face padding and the head of each base and the feet. Indicia is also embroidered there adjacent. The embroidery is lines in the form of a mouth and nose for each face, circles in the feet, and commercial indicia. The embroidery is of black thread.

Next provided is a ribbon for each base. The ribbon is in the form of a bow tie. Stitches couple the ribbons to the bases between the tummies and the faces.

Finally, secondary stitching couples the bases to the pockets with a portion of the legs coupled to the pants below the pockets. The secondary stitching is located adjacent to the large peripheries. In this manner, as the wearer moves, the strands of the high pile fabric will fall under the influence of gravity to cover different portions of the to vary the appearance of the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved embellished jeans system which has all of the advantages of the prior art embellished clothing of known designs and configurations and none of the disadvantages.

It is another object of the present invention to provide a new and improved embellished jeans system which may be easily and efficiently manufactured and marketed.

It is further object of the present invention to provide a new and improved embellished jeans system which is of durable and reliable constructions.

An even further object of the present invention is to provide a new and improved embellished jeans system which is susceptible of a low cost of manufacture with regard to both materials and labor, and which accordingly is then susceptible of low prices of sale to the consuming public, thereby making such embellished jeans system economically available to the buying public.

Even still another object of the present invention is to provide an embellished jeans system for varying the appearance of garment decorations in response to wearer movement in an entertaining, eye-appealing and economical manner.

Lastly, it is an object of the present invention to provide a new and improved embellished jeans system having a decorative patch with a base with a head, legs, arms and a torso, all fabricated of a high pile fabric. A plurality of paddings include a tummy, feet, face, eyes and ears, all fabricated of a felted fabric. Stitching couples the paddings to the base. Embroidery through the face padding forms a nose and a mouth. A ribbon in the form of a bow tie is coupled to the base between the tummy and the face.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of an embellished jeans system constructed in accordance with the principles of the present invention.

FIG. 2 is a cross sectional view taken along line 2-2 of FIG. 1.

The same reference numerals refer to the same parts throughout the various Figures.

DESCRIPTION OF THE PREFERRED EMBODIMENT

Figure 3:
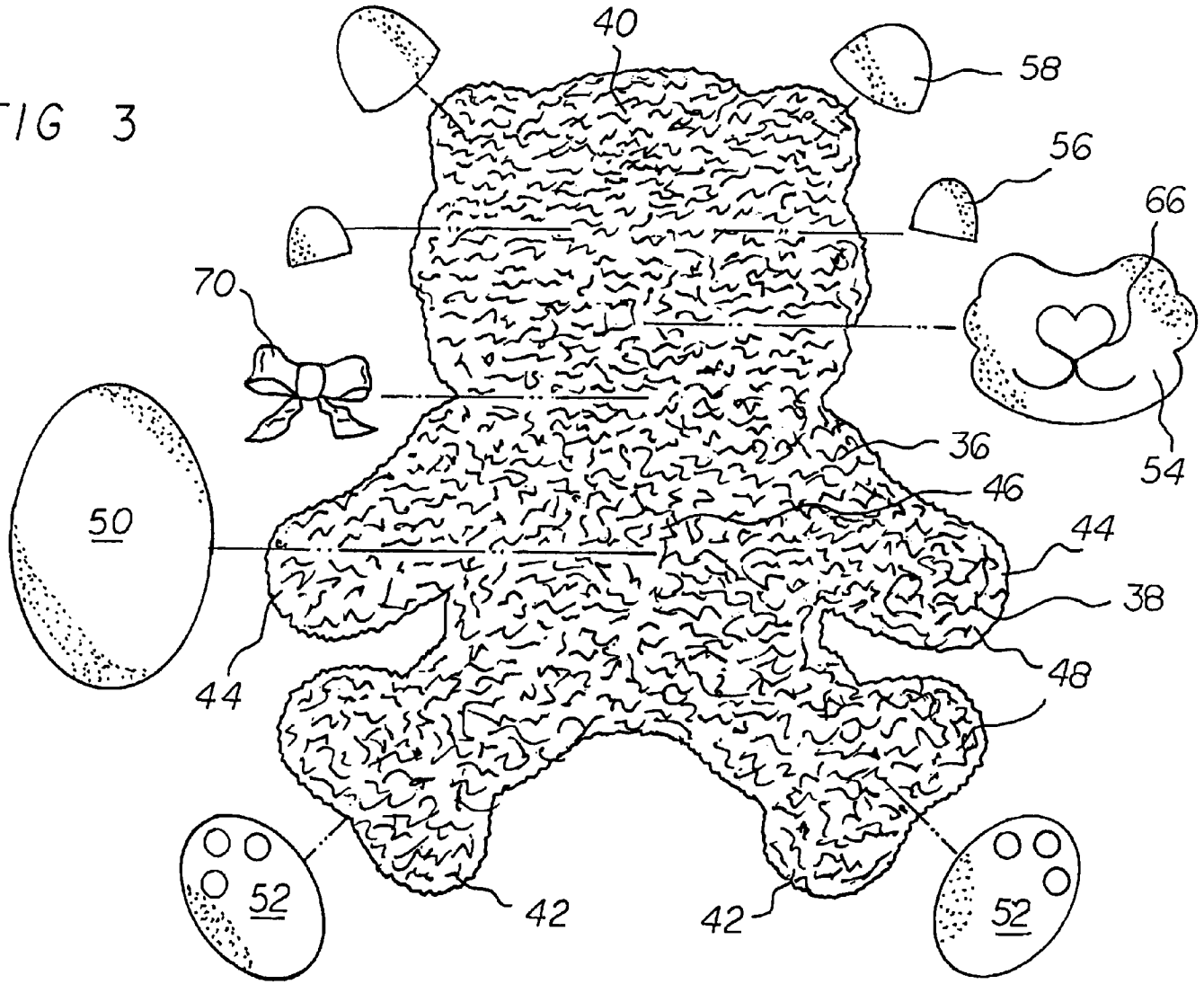
FIG. 3 is an exploded view of a decorative patch shown in the prior Figures.

With reference now to the drawings, and in particular to FIG. 1 thereof, the preferred embodiment of the new and improved embellished jeans system embodying the principles and concepts of the present invention and generally designated by the reference numeral 10 will be described.

The present invention, the embellished jeans system 10 is comprised of a plurality of components. Such components in their broadest context include a decorative patch, a plurality of paddings, stitching, embroidery and a ribbon. Such components are individually configured and correlated with respect to each other so as to attain the desired objective.

The embellished jeans system 10 of the present invention is for varying the appearance of garment decorations in response to wearer movement. The varying of appearance is in an entertaining, eye-appealing and economical manner.

First provided is a pair of pants 14. In the preferred embodiment, the pants are jeans. Other lengths and types of pants may be utilized in other embodiments of the invention, including trousers, shorts, capri pants, cargo pants, cropped pants, and the like. The pants have an upper extent 16 positionable around a waist and hips of a wearer. The pants have a lower extent 18 in the form of two tubular members positionable around the legs of a wearer. The pants have a front 20 and a back 22. Two similarly configured and laterally spaced pockets 24 are stitched to the back of the pants at the upper extent. Each pocket has a generally rectangular configuration with a top 26 and a bottom 28 and sides 30. Each pocket has a height of between 5 inches and 7 inches and a width of between 4 inches and 6 inches. The pants are fabricated of a relatively stiff denim fabric. Other embodiments of the invention may utilize other fabrics for the pants, including fabrics which are stretchable.

Next provided are two similarly configured decorative patches 34. Each patch has a base 36 with a large periphery 38 corresponding to an outline of a bear. Each base has a head 40 above, legs 42 below, arms 44 intermediate and a torso 46. Each torso is centrally coupled to the head, the legs and the arms. Each base is fabricated of a high pile fabric of false fur. The high pile fabric is formed with strands 48 having a length of between 0.50 inches and 0.75 inches. The high pile fabric is of a first color.

Next, a plurality of paddings 50, 52, 54, 56, 58 is provided for each base. The paddings include a large oval tummy 50 on the torso, two small oval feet 52 on the legs, a shaped face 54 on the head, two small semicircular eyes 56 on the head above the face, and two large semicircular ears 58 on the head above the eyes. All of the paddings are fabricated of a felted fabric with smooth surfaces. Each of the paddings has a small periphery.

Primary stitching 62 couples the small periphery of each padding to the base. The paddings are white and the primary stitching is black for visual contrast. Other visually contrasting color combinations are provided in alternate embodiments of the invention.

Embroidery 66 is provided through each face padding and the head of each base and the feet. Indicia is also embroidered there adjacent. The embroidery is lines in the form of a mouth and nose for each face, circles in the feet, and commercial indicia. The embroidery is of black thread. The embroidery may be other colors in alternate embodiments of the invention.

Next provided is a ribbon 70 for each base. The ribbon is in the form of a bow tie. Stitches 72 couple the ribbons to the bases between the tummies and the faces.

Finally, secondary stitching 76 couples the bases to the pockets with a portion of the legs coupled to the pants below the pockets. The secondary stitching is located adjacent to the large peripheries. In this manner, as the wearer moves, the strands of the high pile fabric will fall under the influence of gravity to cover different portions of the to vary the appearance of the system.

The present invention is jeans with teddy bears designed on each back pocket. Various furs including washable fake fur are used. Black embroidery thread is used to embroider the eyes, nose, mouth and the circles of each teddy bear paw. Different thread is used for embroidering. The padding of each paw, face, ear and tummy will normally be white. An exception is that the black bear padding will be brown. The ribbon will be in various colors. Indicia may also be embroidered. The preferred embodiments are in a line of clothing for females in sizes for women, ladies, teens and children.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An embellished jeans system for varying the appearance of garment decorations in response to wearer movement, the system comprising, in combination:

pants having an upper extent positionable around waist and hips of a wearer, the pants having a lower extent in the form of two tubular members positionable around the legs of a wearer, the pants having a front and a back, two similarly configured and laterally spaced pockets stitched to the back of the pants at the upper extent, each pocket having a generally rectangular configuration with a top and a bottom and sides and with a height of between 5 inches and 7 inches and a width of between 4 inches and 6 inches, the pants being fabricated of a relatively stiff denim fabric;

two similarly configured decorative patches, each patch having a base with a large periphery corresponding to an outline of a bear, each base having a head above and legs below and arms intermediate and a torso, each torso being centrally coupled to the head and the legs and the arms, each base being fabricated of a high pile fabric of false fur, the pile fabric formed with strands having a length of between 0.50 inches and 0.75 inches, the pile fabric being of a first color;

a plurality of paddings for each base and including a large oval tummy on the torso, two small oval feet on the legs, a shaped face on the head, two small semicircular eyes on the head above the face and two large semicircular ears on the head above the eyes, all of the paddings being fabricated of a felted fabric with smooth surfaces, each of the paddings having a small periphery;

primary stitching coupling the small periphery of each padding to the base, the paddings being white and the primary stitching being black for visual contrast;

embroidery through each face padding and the head of each base and the feet and indicia there adjacent, the embroidery being lines in the form of a mouth and nose for each face and circles in the feet and commercial indicia, the embroidery being of black thread;

a ribbon in the form of a bow tie for each base with stitches coupling the ribbons to the bases between the tummies and the faces; and secondary stitching coupling the bases to the pockets with a portion of the legs coupled to the pants below the pockets, the secondary stitching being located adjacent to the large peripheries, wherein the strands of the high pile fabric will fall under the influence of gravity to cover different portions of the patches as the wearer moves to vary the appearance of the system.

* * * * *